United States Patent [19]

Zboralski et al.

[11] 4,434,711

[45] Mar. 6, 1984

[54] FUME HOOD WITH DAMPER CONTROLLED BAFFLES AND METHOD

[75] Inventors: Jon A. Zboralski, Manitowoc; Harry N. Grow, Two Rivers, both of Wis.

[73] Assignee: Hamilton Industries, Inc., Two Rivers, Wis.

[21] Appl. No.: 219,676

[22] Filed: Dec. 24, 1980

[51] Int. Cl.[3] ..... F23J 11/00

[52] U.S. Cl. ..... 98/116 LH; 98/43 B

[58] Field of Search ..... 98/115 R, 115 LH, 42 R, 98/43 R, 43 B; 55/DIG. 16

[56] References Cited

U.S. PATENT DOCUMENTS

| | | | |
|---|---|---|---|
| 1,010,790 | 12/1911 | Ogan | 426/288 |
| 1,176,075 | 3/1916 | Mann | 98/115 R X |
| 1,934,808 | 11/1933 | Liptay | 98/115 LH |
| 1,968,532 | 7/1934 | Liptay | 98/115 LH |
| 1,972,917 | 9/1934 | Buckel | 98/115 LH |
| 2,590,577 | 3/1952 | Ruemelin | 98/115 LH |
| 2,627,220 | 2/1953 | Morrow | 98/115 LH |
| 2,702,505 | 2/1955 | Nelson | 98/115 LH |
| 2,704,505 | 3/1955 | Morrison | 98/115 LH |
| 2,779,265 | 1/1957 | Liptay | 98/115 LH |
| 3,022,718 | 2/1962 | Thompson | 98/115 LH |
| 3,218,953 | 11/1965 | Grow et al. | 98/115 LH |
| 3,745,908 | 7/1973 | Mayberry | 98/115 LH |
| 3,897,721 | 8/1975 | Fuhst | 98/115 LH X |
| 4,031,819 | 6/1977 | Applewhite | 98/115 R |
| 4,177,716 | 12/1979 | Bowe et al. | 98/115 SB |
| 4,177,717 | 12/1979 | Grow et al. | 98/115 LH |

*Primary Examiner*—Henry C. Yuen
*Assistant Examiner*—Harold Joyce
*Attorney, Agent, or Firm*—Tilton, Fallon, Lungmus

[57] ABSTRACT

A fume hood having top and rear baffle systems fixedly secured within a housing of the fume hood to provide a passage for lighter than air fumes along the top baffle and a passage for heavier than air fumes along the rear baffle. A movable damper selectively connects these passages with an exhaust of the fume hood, and this movable damper is remotely controlled from outside the fume hood adjacent the work area of the fume hood. An operator can control fume flow within the hood while the work area is closed by a sash.

10 Claims, 8 Drawing Figures

FUME HOOD WITH DAMPER CONTROLLED BAFFLES AND METHOD

BACKGROUND

Laboratory fume hoods are frequently used to exhaust the fumes that are lighter than air and fumes that are heavier than air. When handling lighter than air fumes, it is advantageous to adjust the fume baffle system so that the exhaust pulls air in from an upper portion of the hood while openings through the baffle system to the exhaust in a lower portion of the fume hood are reduced or closed off. Conversely, when handling heavier than air fumes, the inlets to upper portions of baffle systems are reduced or closed off while inlet ports adjacent a lower portion of the fume hood are increased or open. This is sometimes done by angularly moving the entire baffle systems as shown in FIG. 2 of the Grow and Puls U.S. Pat. No. 3,218,953. Other forms of manually moved baffle systems are shown in U.S. Pat. Nos. 1,972,917; 2,627,220; 2,779,265; and 3,022,718. These prior fume hoods are often burdensome to change between lighter than air fumes and heavier than air fumes. Often they require the operator to reach into the hood and make major changes to the baffle system. This was often time consuming because the fume hood had to be completely cleared of any hazardous fumes before the operator would go into the fume hood and alter the physical structure of the baffles, usually which were at the top and back areas of the fume hood.

Other fume hoods have used movable dampers simply to open and shut the exhaust port, often to conserve energy, such as preventing cold air from entering through the exhaust duct work during winter when the building was heated. These movable dampers, such as shown in U.S. Pat. Nos. 1,968,532; 2,590,577; 2,702,505; and 4,177,716, operate in much the same manner as flue vents on stove or fireplace chimneys to open and close the chimney. They were not used in conjunction with baffle systems forming passages at an upper and rear portion of the fume hood for selectively controlling lighter than air and heavier than air fumes.

U.S. Pat. No. 3,897,271 deals with a movable damper-like system for controlling incoming auxiliary air to a fume hood, but does not alter the flow passages of baffle systems for controlling lighter than air and heavier than air fumes.

U.S. Pat. No. 4,177,717 shows the use of rear baffles that can be either fixed or movable relative to a rear wall of the fume hood. As with several of the patents mentioned previously, movement of the baffle itself requires operator entrance into the fume hood.

SUMMARY OF THE INVENTION

The applicants have invented an improved fume hood in which an operator can readily change the fume hood for handling lighter than air fumes to a fume hood for handling heavier than air fumes and vice versa. All of this can be done while the fume hood's sash is closed and operator entrance into the hood is not required. A top baffle system and rear baffle system for handling lighter than air fumes and heavier than air fumes can be fixedly secured to the fume hood and need not be moved by an operator. A movable damper adajcent the exhaust selectively connects one of the baffle systems to the exhaust while reducing or closing off the flow from the other baffle. Movement of the damper is remotely controlled from the point adjacent the work area of the fume hood, and can be controlled when the sash is closed.

THE DRAWINGS

DETAILED DESCRIPTION

Figure 1:
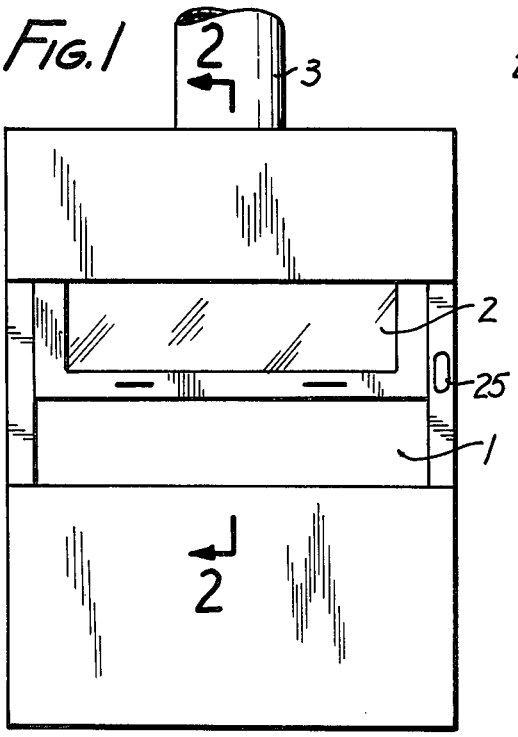
FIG. 1 is a front elevational view of the fume hood.

The fume hood shown in FIG. 1 includes a work area 1 that is open and closed by a sash 2. At an upper end of the fume hood is an exhaust conduit 3 that normally is connected to a blower for sucking fumes out of the hood. Since the blower is conventional, it has not been shown in the drawings.

Figure 2:
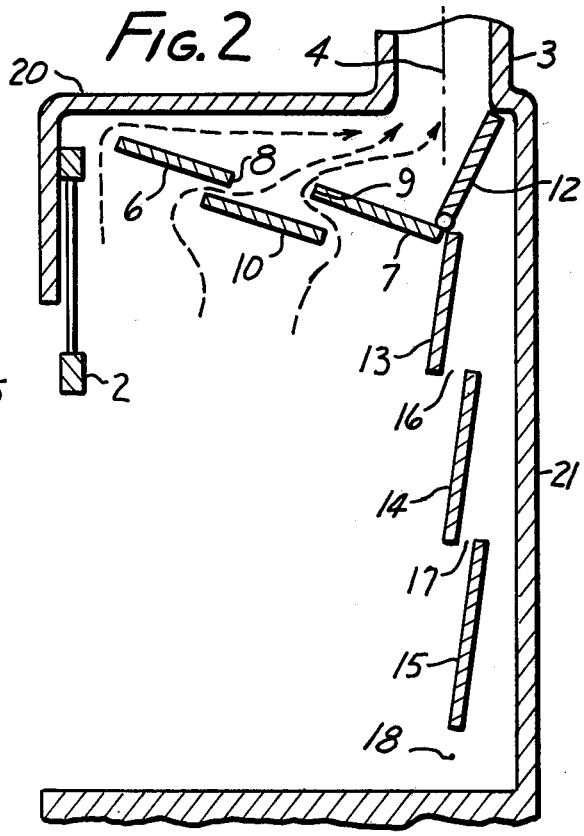
FIG. 2 is a schematic sectional view taken along line 2—2 of FIG. 1 showing fixed top and rear baffle systems and a damper in position so lighter than air fumes flow along the top baffle to the exhaust.

In laboratory hoods, there are certain fumes that are lighter than air and thus, tend to accumulate in an upper portion of the fume hood. As shown in the schematic view in FIG. 2, these lighter than air fumes are sucked through parts in a top baffle where these fumes pass a port 4 into the exhaust conduit 3. The purpose of the top baffle is to distribute the inlet openings through the baffle so that the fume hood will such fumes from all areas of the upper portion of the fume hood. As shown in FIG. 2, the top baffle includes a pair of spaced apart panels 6 and 7 which have inner ends 8 and 9. A center panel 10 is spaced below panels 6 and 7 and provides a gap between the three panels of the top baffle. Since these three panels 6, 7, and 10 are shown schematically, there is no structure shown holding the three panels together. However, it is understood that certain clip structures can be used to hold these panels together while maintaining a gap between the panels. Preferably, the top baffle system, formed of the three panels, has a forward end that is spaced above the rearward end of the top baffle. This helps distribute the lighter than air gases and the top baffle system is thus slightly tilted to face the open work area beneath the sash.

In FIG. 2, most of the fumes within the hood are sucked through or around the top baffle because a movable damper 12 is positioned to close off most of the air flow from a rear baffle system formed of three rear panels 13, 14, and 15 which have inlet gaps 16, 17, and 18. In order to function as shown in FIG. 2, it is not necessary that damper 12 completely close off and tightly seal against the housing in the position shown in FIG. 2. A small bleed or leak of air and fumes through the rear baffles to the exhaust can be accomodated. The purpose here is to direct the majority of the sucking action of the blower to an upper portion of the fume hood adjacent the top baffle, as shown in FIG. 2.

Figure 3:
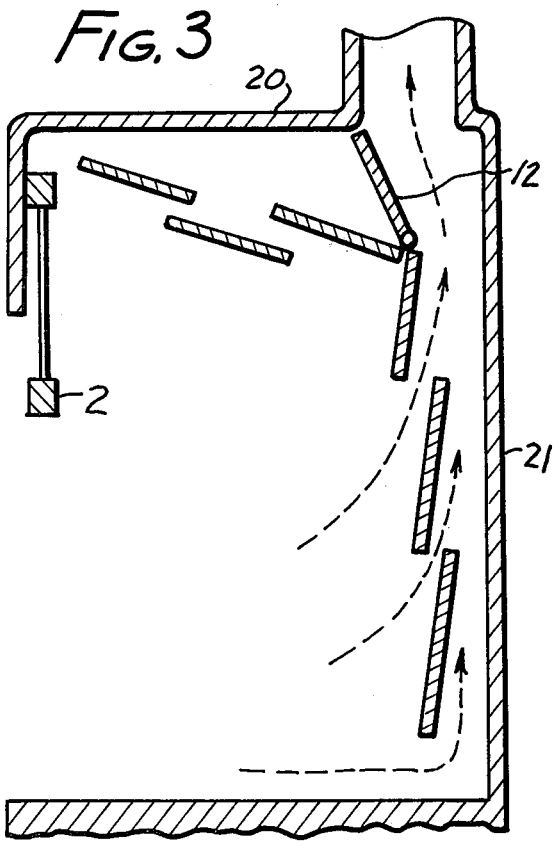
FIG. 3 is a view similar to FIG. 2, but showing the damper in position where heavier than air fumes flow along the rear baffle to the exhaust.

When the fume hood is used for heavier than air fumes, the damper 12 is moved to the position shown in FIG. 3. Here the rear baffle combines with the rear wall and forms a passage for the heavier than air fumes to the exhaust conduit 3. Here again, if there is some leak through the top baffle, this is not critical so long as most of the sucking action is directed to gases falling along the rear baffle.

In both FIGS. 2 and 3, it can be seen that the top baffle combines with a top wall 20 to form a passage to the exhaust. The rear baffle combines with a rear wall 21 to also form a fume flow passage to the exhaust. In the top and rear baffle systems, three panels have been schematically illustrated for each. However, any number of panels could be used in these baffles, if desired. Also, various clip devices could be used to separate the gaps between the panels in both the top and rear baffles. Preferably, the rear baffle has at least one panel with a lower end portion that is spaced in front of and forms a gap with an upper portion of a panel immediately below.

An important advantage of the present fume hood is that the top and rear baffles can be fixedly secured to the fume hood housing and an operator need not enter the fume hood housing to mechanically alter the position of the baffles. Fixed baffles also prevent apparatus and glass from being upset during movement of such baffles. The movable damper 12 can be remotely controlled by an operator outside the fume hood by means of a control handle 25 that is exposed on the fume hood adjacent the work opening 1, as shown in FIG. 1. Thus, the damper 12 can be moved from positions shown in FIGS. 2 and 3 while the fume hood sash 2 is closed. Thus, there is no need to expose the operator to any residual fumes that may be in the fume hood when changing from lighter than air fumes to heavier than air fumes or vice versa.

Figure 4:
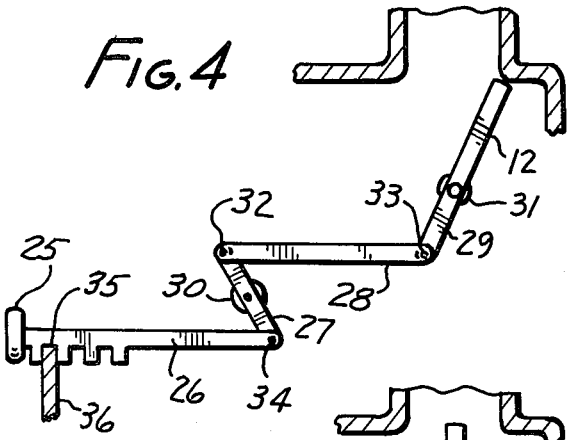
FIG. 4 is a fragmentary view showing the damper actuator with the damper in the position shown in FIG. 2.
Figure 5:
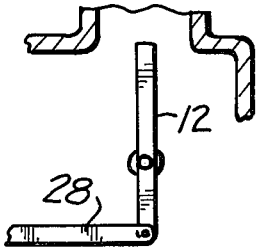
FIG. 5 is a fragmentary view showing the damper in an intermediate position where fumes can flow along both baffle systems to the exhaust.
Figure 6:
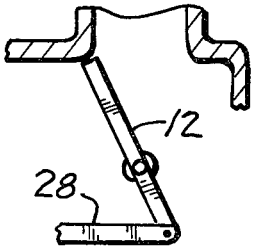
FIG. 6 is a fragmentary view showing a portion of the actuator connected to the damper when the damper is in the position shown in FIG. 3.

As shown in FIG. 4, the control handle 25 is connected to pivoted linkage members 26, 27, 28, and extension 29 is connected to baffle 12. Pivot areas 30 and 31 are pivot points that are molded or otherwise secured to the fume hood. Pivots 34, 32, and 33 may be termed free floating pivots so that the physical position of these pivots 34, 32, and 33 may move as the control handle 25 is pushed and pulled. A series of notches in member 26, such as 35, can lock the damper 12 in a particular position, as shown in FIG. 4. By using a different notch, the damper can be moved and locked into an intermediate position, as shown in FIG. 5. In this position, the suction applied by a blower in the exhaust (not shown) can equally draw fumes through the top and rear baffles. When still another notch is used in member 26, the baffle 12 is locked in the position shown in FIG. 6, and the fume hood operates in the manner illustrated in FIG. 3.

Figure 7:
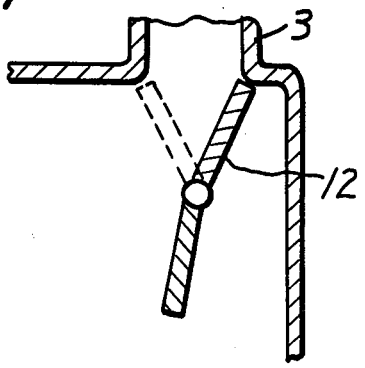
FIG. 7 is a schematic view showing an alternate embodiment wherein the movable damper is pivotally connected to one of the baffles.
Figure 8:
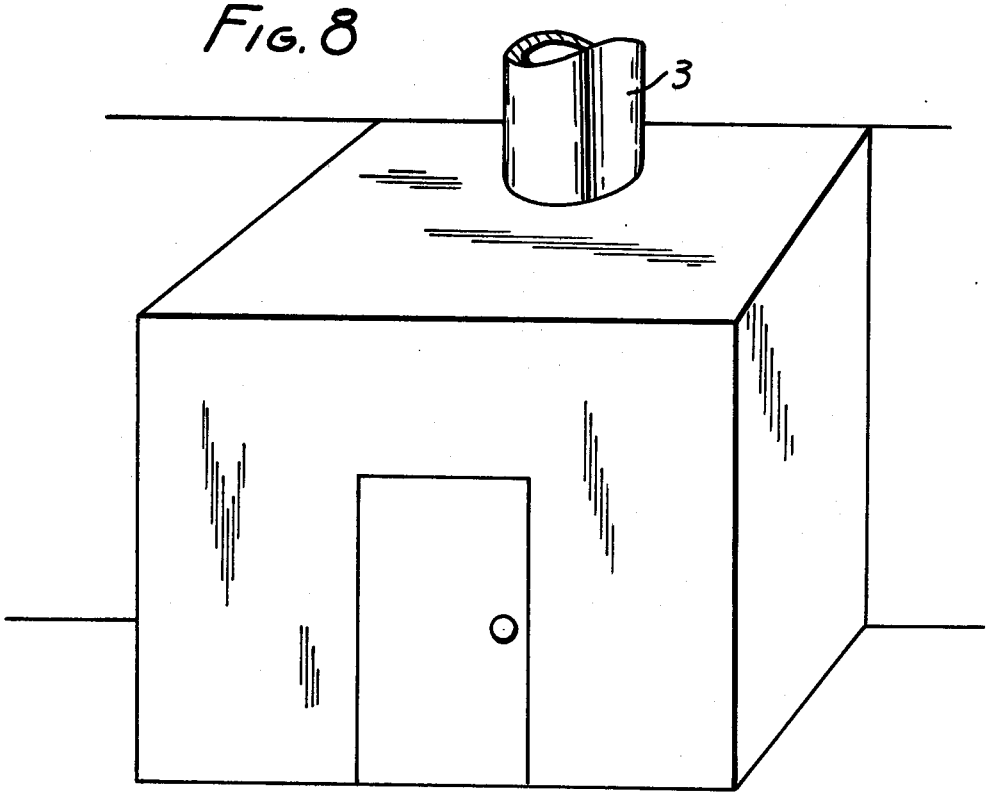
FIG. 8 is a schematic view showing an alternate version of the fume hood wherein the housing includes an entire room of a building.

Alternate versions of the fume hood described above can include a pivoted damper mounted directly on one of the baffles. The drawing in FIG. 7 shows the pivoted damper mounted on the rear baffle, but it could just as easily be mounted on the top baffle, if desired. An alternate version shown in FIG. 8 includes a total room of a building being used as the housing for the fume handling enclosure.

While it is preferred that the baffles remain fixed and the damper be moved, the baffles can be made movable, if desired. Also, if desired, these movable baffles could be remotely controlled in a manner similar to the remote control device shown in FIG. 4.

In the above description, a specific example has been used to describe the invention. However, it is understood by those skilled in the art that certain modifications can be made to this embodiment without departing from the spirit and scope of the invention.

We claim:

1. A fume handling enclosure comprising a housing having top and rear walls meeting at an upper rear portion of said housing and having an exhaust opening located at said upper rear portion; a top baffle within said housing extending along and spaced below said top wall to define a generally horizontal fume passage therebetween; said top baffle having a rear end spaced forwardly from said rear wall and being provided with a plurality of openings for receiving lighter-than-air gases into said horizontal fume passage for directing the same towards said exhaust opening; a rear baffle within said housing spaced forwardly from said rear wall for defining a generally vertical fume passage therebetween; said rear baffle having an upper end spaced below said top wall and disposed adjacent the rear end of said top baffle; said rear baffle having at least one opening for receiving gases into said vertical fume passage; a movable damper disposed within said housing adjacent said exhaust opening; means pivotally supporting said damper for movement about a generally horizontal pivot line disposed adjacent the rear end of said upper baffle and the upper end of said rear baffle; said damper being pivotal between first and second positions for controlling the flow of fumes through said passages to said exhaust opening; said damper when in said first position substantially closing said vertical fume passage and opening said horizontal fume passage to said exhaust opening, and when in said second position substantially closing said horizontal fume passage and opening said vertical fume passage to said exhaust opening; and activating means connected to said damper and extending externally of said housing for controlling the position of said damper from the exterior of said housing.

2. The fume handling enclosure of claim 1 in which said top baffle includes a plurality of overlapping panels, said openings of said top baffle being provided between said panels.

3. The fume handling enclosure of claim 1 in which said rear baffle has a plurality of said opening for receiving gases into said vertical fume passage.

4. The fume handling enclosure of claim 3 wherein said rear baffle includes a plurality of overlapping panels, said openings in said rear baffle comprising gaps between the overlapping panels thereof.

5. The fume handling enclosure of claim 1 in which said activating means is adjustable for pivoting and retaining said damper in an intermediate position wherein both said horizontal fume passage and said vertical fume passage communicate with said exhaust opening.

6. A fume handling enclosure comprising a housing having top and rear walls meeting at an upper rear portion of said housing and having an exhaust opening located at said upper rear portion; a stationary buffle within said housing extending along and spaced below said top wall to define a generally horizontal fume passage therebetween; said stationary top baffle having a rear end spaced forwardly from said rear wall and being provided with a plurality of openings for receiving upwardly moving gases into said horizontal fume passage for directing the same towards said exhaust opening; a stationary rear baffle within said housing spaced forwardly from said rear wall for defining a generally vertical fume passage therebetween; said stationary rear baffle having an upper end spaced below said top wall and disposed at the rear end of said top baffle; said rear baffle having at least one opening for receiving gases into said vertical fume passage; a movable damper disposed within said housing adjacent said exhaust opening; means pivotally supporting said damper for movement about a generally horizontal pivot line disposed adjacent the rear end of said upper baffle and the upper end of said rear baffle; said damper being pivotal between first and second positions for controlling the flow of fumes through said passages to said exhaust opening; said damper when in said first position substantially closing said vertical fume passage and opening said horizontal fume passage to said exhaust opening, and when in said second position substantially closing said horizontal fume passage and opening said vertical fume passage to said exhaust opening; and controlling means connected to said damper and extending externally of said housing for manually controlling the position of said damper from the exterior of said housing.

7. The fume handling enclosure of claim 6 in which said stationary top baffle includes a plurality of overlapping panels; said openings of said top baffle comprising gaps between the overlapping panels thereof.

8. The fume handling enclosure of claim 6 in which said stationary rear baffle has a plurality of said openings for receiving gases into said vertical fume passage.

9. The fume handling enclosure of claim 8 wherein said stationary rear baffle includes a plurality of overlapping panels; said openings in said rear baffle comprising gaps between the overlapping panels thereof.

10. The fume handling enclosure of claim 6 in which said controlling means is adjustable for pivoting and retaining said damper in an intermediate position wherein both said horizontal fume passage and said vertical fume passage communicates with said exhaust opening.

* * * * *